United States Patent [19]

Tsukamoto

[11] Patent Number: 5,018,560

[45] Date of Patent: May 28, 1991

[54] DEVELOPER SUPPLYING STRUCTURE FOR A DEVELOPING DEVICE

[75] Inventor: Kimihide Tsukamoto, Yamatokoriyama, Japan

[73] Assignee: Sharp Kabushiki Kaisha, Osaka, Japan

[21] Appl. No.: 473,839

[22] Filed: Feb. 1, 1990

[30] Foreign Application Priority Data

Feb. 7, 1989 [JP] Japan ..... 1-13789[U]

[51] Int. Cl.[5] ..... B65B 1/04; G03G 15/06

[52] U.S. Cl. ..... 141/364; 141/320; 355/260

[58] Field of Search ..... 141/319, 320, 322, 346, 141/351, 353, 354, 360, 362–366; 355/260; 222/DIG. 1

[56] References Cited

U.S. PATENT DOCUMENTS 4,062,385 12/1977 Katusha et al. ..... 141/364
4,650,070 3/1987 Oka et al. ..... 222/DIG. 1
4,778,086 10/1988 Shibata et al. ..... 141/364
4,799,608 1/1989 Oka ..... 222/DIG. 1
4,895,104 1/1990 Yoshino et al. ..... 355/260

*Primary Examiner*—Henry J. Recla
*Assistant Examiner*—Keith Kupferschmid

[57] ABSTRACT

A developer supplying structure of a developing device includes a device body formed with an opening through which a developer is dispersed; a lid for the opening; a developer cartridge formed with an outlet corresponding to the opening of the device body, and detachably mounted on the device body; and a seal member folded in two portions in which one portion seals the opening of the developer cartridge and the other portion is left free as a flap; the seal member being torn off from the opening of the developer cartridge by pulling the flap; a sliding member provided between the two portions and sliding the lid interlocking with pulling the flap; and a pair of projections laterally formed in the lid and a pair of claws coming in contact with the projections and moving the lid in the direction to expose the opening of the device body.

17 Claims, 9 Drawing Sheets

DEVELOPER SUPPLYING STRUCTURE FOR A DEVELOPING DEVICE

BACKGROUND OF THE INVENTION

1. Field of the Invention

The present invention relates to a developer supplying structure for a developing device and, more specifically, it relates to a developer supplying structure for supplying developer from an opening of a cartridge through an opening formed in a body of a developing device.

2. Description of the Prior Art

Conventionally, a developer supplying structure of a developing device comprises a cartridge for supplying developer from its opening to an opening of a body of the developing device, and a seal member folded in two portions in which one portion is affixed to the opening of the cartridge and the other portion is left free as a flap.

In supplying the developer, after a lid of the body of the developing device is removed, the cartridge is attached and the affixed portion is torn off by pulling the flap of the seal member so as to dispense the developer (toner).

After the developer is dispensed, the cartridge is detached and the lid is returned to its place on the body of the developing device.

With the above-mentioned prior art, however, the developer may sometimes splash from the device body because the lid is removed from the device body before the cartridge is attached in supplying the developer and it is returned to its position after dispensing of the developer, and the inside of a copying machine and surroundings thereof may be stained.

Additionally, the developer remaining in the cartridge may be splashed, for example, when the cartridge is detached from the device body, because the seal is torn off from the cartridge after the completion of dispensing, and thus the inside of the copying machine and the surroundings thereof may be stained.

The U.S. Pat. No. 4,491,161 discloses means for solving these problems. In a developer supplying structure of the developing device as disclosed in this patent, a sliding lid of a cartridge is moved to an opening position cooperative with opening a lid provided in an opening of a body of the developing device. A seal member held by the sliding lid is moved as the sliding lid is opened, to tear off one portion of the seal member affixed to the opening of the cartridge, and thus the opening of the cartridge is left opened. However, the seal member is torn off through opening the lid of the developing device and the sliding lid of the cartridge.

The cartridge is usually made of paper or plastic sheet, and the seal member is made of a plastic sheet material. The one portion of the seal member is affixed to the peripheral portion of the opening of the cartridge with an appropriate adhesive.

Thus, if the one portion of the seal member is torn off with a large force, the seal member of the cartridge may be broken, or cooperative relations among the cartridge, the seal member, the lid of the device body and the sliding lid of the cartridge may be broken. Thus, it is not easy to supply developer in the cartridge to the body of the developing device.

SUMMARY OF THE INVENTION

A developer supplying structure of a developing device comprises a developer body formed with an aperture through which a developer is supplied; a lid slidably attached to said developer body for selectively opening and closing the aperture; a developer cartridge formed with an outlet corresponding to the aperture formed in the developer body, the developer cartridge being detachably mounted on the developer body; a seal member folded in two portions in which one portion seals the opening of the developer cartridge and the other portion is left free as a flap; the seal member being separated from the outlet of the developer cartridge by pulling the flap to break the seal; a sliding member provided between and at a fold of the two portions of the seal member and slidable with the lid; and means for connecting the sliding member to the lid and moving the lid with movement of a sliding member in the direction for opening the developer body wherein the lid is simultaneously removed upon removal of the seal and the seal is simultaneously replaced upon replacement of the lid.

In accordance with the present invention, the one portion of the seal member is separated from the cartridge by directly pulling not the lid of the device body but the seal member so as to regulate the pulling force corresponding to the condition of tearing off the one portion, so that the developer can be easily and assuredly supplied from the cartridge to the body of the developing device without breaking the seal member and the cartridge.

DETAILED DESCRIPTION OF THE PREFERRED EMBODIMENTS

Now, embodiments according to the present invention will be described with reference to the accompanying drawings.

<First Embodiment>

Figure 1:
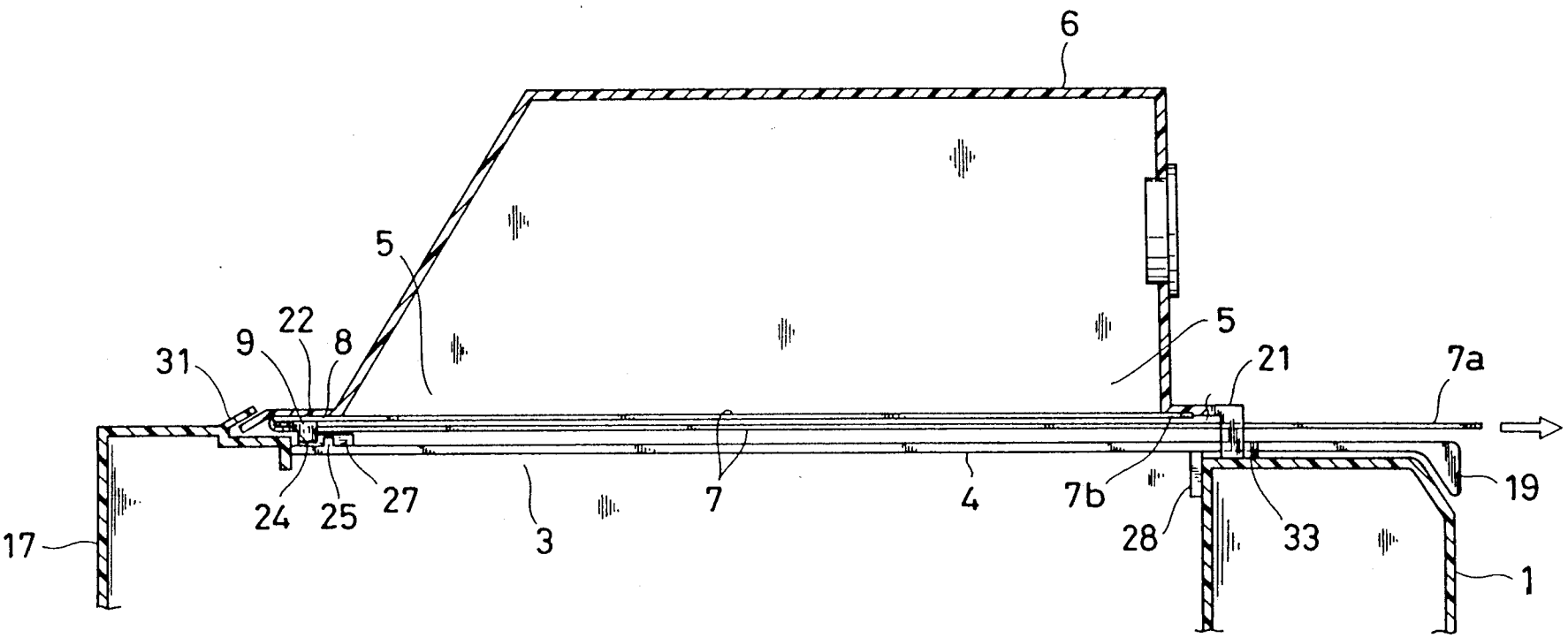
FIG. 1 is a sectional side view showing a first embodiment of a developer supplying structure of a developing device of the present invention, sealed with a seal member.
Figure 2:
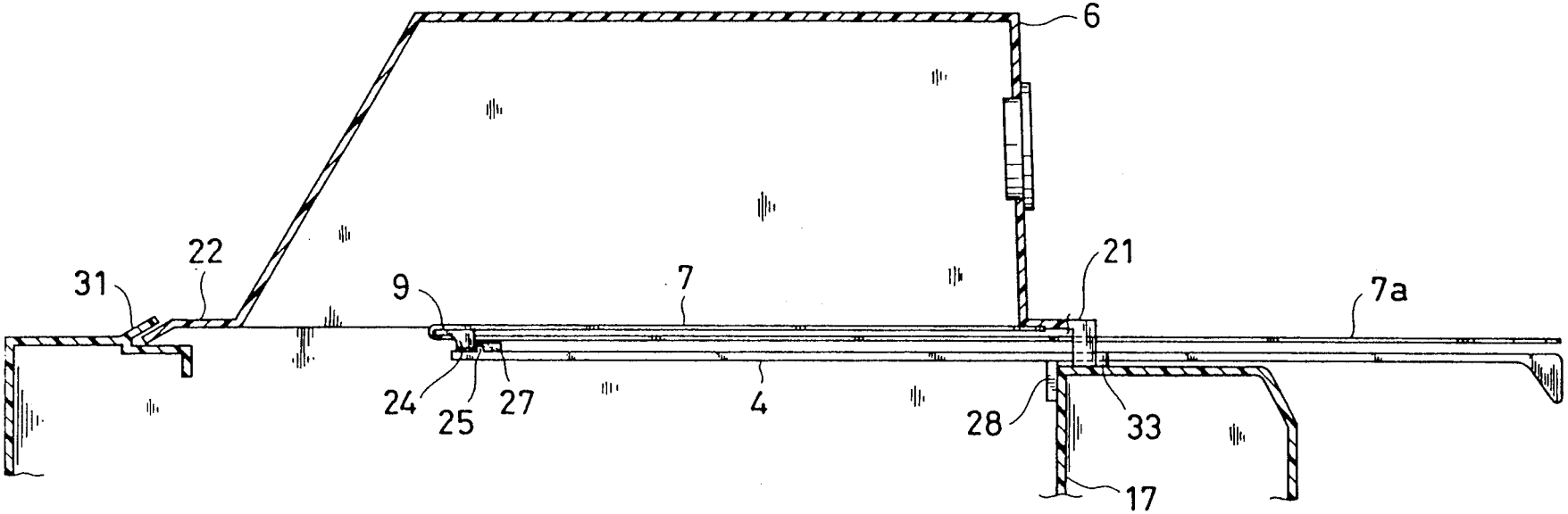
FIG. 2 is a sectional side view showing the first embodiment with the seal member being removed.
Figure 3:
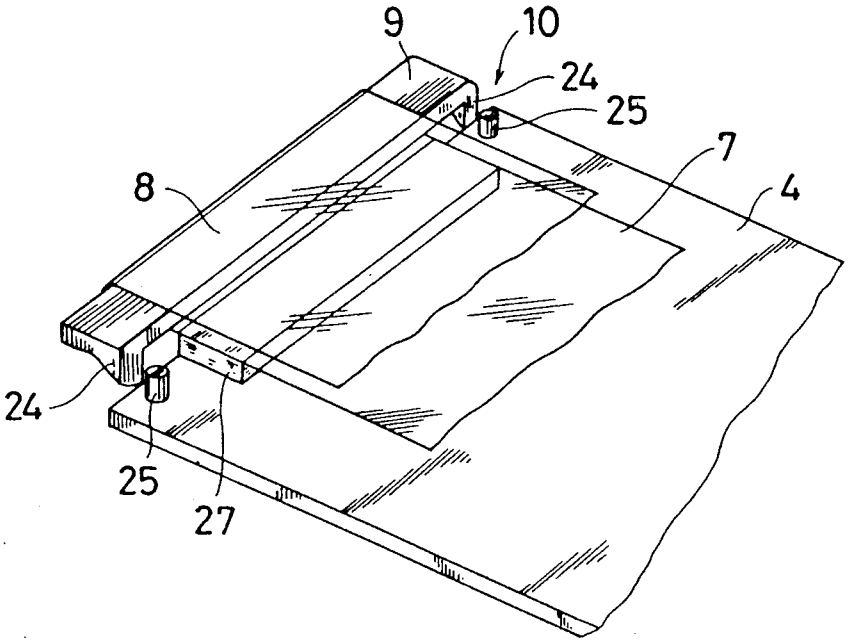
FIG. 3 is a perspective view showing the relationship between a sliding member of a cartridge and a lid of a body of the developing device.

FIG. 1 is a sectional side view showing a first embodiment of a developer supplying structure of a developing device of the present invention, sealed with a seal member; FIG. 2 is a sectional side view showing the first embodiment with the seal member being removed; FIG. 3 is a perspective view showing the relationship between a sliding member of a cartridge and a lid of a body of the developing device; and FIG. 4 is a sectional front view showing the developing device.

As shown in these figures, the developer supplying structure of the developing device according to the present invention is comprised of a body 1 formed with an opening 3 for receiving developer 2, a lid 4 sliding in the longitudinal direction to open and close the opening 3, a cartridge 6 containing the developer 2, formed with an outlet 5 for dispensing the developer 2 and capable of attaching to and detaching from the body 1, a seal member 7 folded in its middle portion with its one end 7*a* free, for sealing the outlet 5 of the cartridge 6, a sliding member 9 provided inside one portion 8 of the seal member 7 and moving in the direction corresponding to the sliding direction of the lid 4 in accordance with removal of the seal member 7, and cooperative means 10 for moving the lid 4 in its opening position with the sliding member 9 upon removal of the seal member 7.

Figure 4:
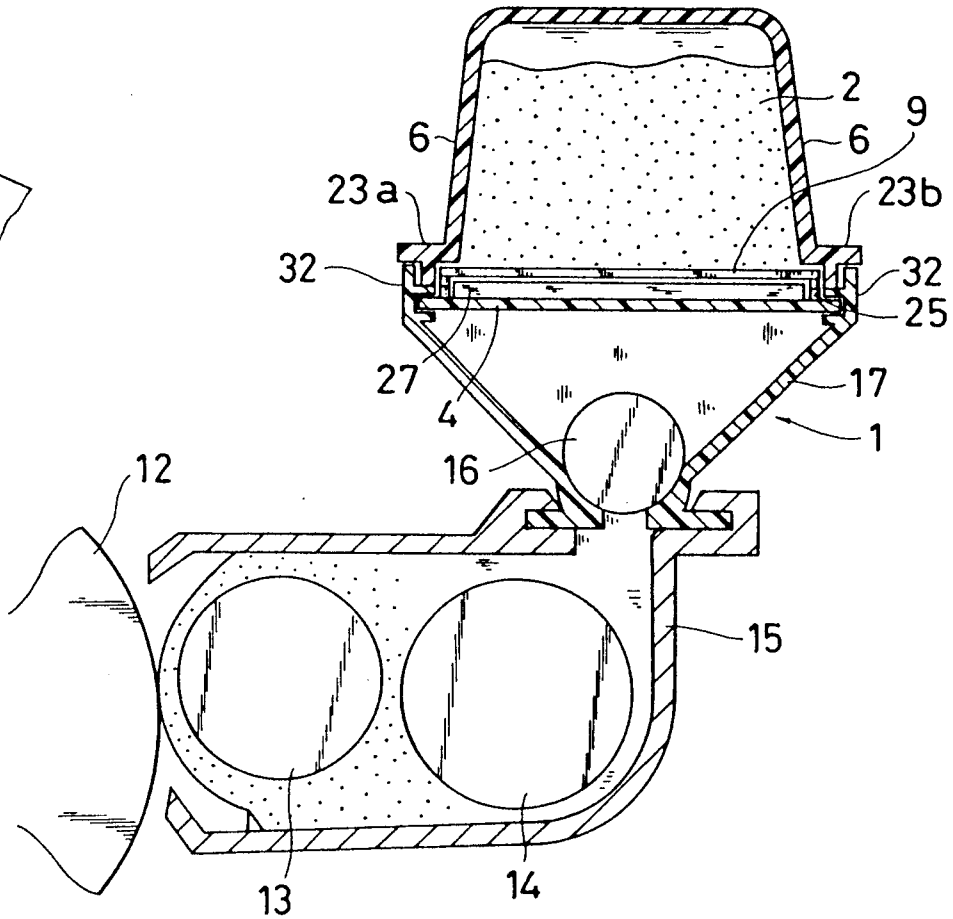
FIG. 4 is a sectional front view showing the developing device.

As shown in FIG. 4, the body 1 of the developing device includes a housing 15 provided with a developing roller 13 for depositing the developer 2 (toner) on a photoconductor 12 and a stirring roller 14 within the housing 15, and a reservoir 17 (toner hopper) having a roller 16 used for supplying the developer 2 (toner).

The lid 4 is positioned in the opening 3 in the upper face of the reservoir 17, capable of sliding in the direction corresponding to the center axis of the developing roller 13 (in the longitudinal direction) and having a gripping member 19 at its leading edge.

As shown in FIGS. 1 and 4, the cartridge 6 is capable of attaching to and detaching from the upper side of the device body 1 and contains the developer 2 (toner). The outlet 5 corresponds to the bottom face of the cartridge 6.

The seal member 7 is removably affixed to the bottom faces of flanges 21, 22, 23*a* and 23*b* formed in the peripheral portion of the outlet 5 of the bottom of the cartridge 6. One end 7*b* of the seal member 7 is affixed to the flange 21 in the front, and the portion 8 is affixed to the flange 22 in the rear. Remaining edges of the seal member 7 are affixed to the flanges 23*a* and 23*b*. Further, the free end 7*a* of the seal member 7 serves as the pull tab extending beyond the front of the cartridge 6.

As shown in a plan view, has almost the same length as the distance between left and right walls of the outlet 5 and is provided with claws 24 integrally formed with the sliding member 9 and in contact with the lid 4 at its left and right ends.

The cooperative means 10 includes the claws 24 and a pair of projections 25 formed in the trailing edge of the lid 4 to come in contact with the claws 24.

As shown in FIG. 3, a first cleaning member 27 which is a rectangular parallelepiped is placed in the trailing edge of the lid 4 between the projections 25 to come into contact with the reverse side of the seal and clean it of the developer 2 as the seal is peeled away from the cartridge by a scraping action from the left side thereof as viewed in FIG. 1. Further, a second cleaning member 28 which is plate-shaped is attached to an edge of the front wall of the device body 1 to come in contact with the reverse side of the lid 4 away from opening 3 and clean it of the developer 2.

As shown in FIGS. 1 and 4, a mechanism 30 for positioning the cartridge 6 in the device body 1 includes a rear stopper 31 formed behind the opening 3 of the device body 1 and fitting to the rear flange 22 of the cartridge 6, a pair of projections formed in the left and right opposite sides of the opening 3 of the device body 1 so that the distance between the inner walls thereof is the same as the lateral length of the cartridge 6, and a front stopper 33 formed in the opposite sides of the lid 4 in the front of the device body 1 and coming in contact with the front flange 21 of the cartridge 6 to block the the cartridge 6 moving in the forward direction.

In order to supply the developer 2 (toner) to the reservoir 17 of the body 1 in the above-mentioned constitution, the body 1 of the developing device is drawn from the body of the copying machine in the forward direction, and thereafter the rear flange 22 of the cartridge 6 is put on the device body 1 from the upper right to fit to the rear stopper 31 of the lid 4. When the rear stopper 31 fits to the rear flange 22, the front edge of the cartridge 6 is moved downward. Then, the cartridge 6 is positioned as shown in FIG. 1 because its left and right ends are caught by the projections 32 and its front end is caught by the front stopper.

Then, the other portion, that is a flap of the seal member 7, is pulled in the direction of the arrow (the forward direction) as shown in FIG. 1 to tear off the seal member 7 from the outlet 5. Simultaneously, the sliding member 9 positioned inside the one portion 8 of the seal member 7 is acted on by the flap of the seal member 7 and moved in the forward direction.

Because of the movement of the sliding member 9, the claws 24 of the sliding member 9 come into contact with the projections 25 of the lid 4, and the lid 4 slides in the forward direction to open cooperative with the movement of the forward direction of the sliding member 9, so that the developer 2 in the cartridge is supplied to the body 1.

At this time, since the first cleaning member 27 is in contact with the reverse side of the seal member 7, the first cleaning member 27 removes the developer 2 on the seal member 7 to prevent the developer 2 from being exposed or carried to the exterior of the device. As indicated above, movement of the seal 7 in the direction of the arrow in FIG. 1 will cause the surface thereof to scrape against a left end of the first cleaning member 27, thereby removing excess toner therefrom for disposal into the reservoir 17. On the other hand, since the second cleaning member 28 is in contact with the reverse side of the lid 4, the second cleaning member 28 removes the developer 2 on the lid 4 to prevent the developer 2 from being carried to exterior of device on the front of lid 4 similar to the above case.

There is no need of providing any special guiding means even when the sliding member 9 slides, because the claws 24 of the sliding member 9 are in contact with the lid 4, but the guiding means may be provided between the sliding member 9 and the cartridge 6.

After dispensing the developer 2 from the cartridge 6, the lid 4 is moved backward by gripping member 19 and pushing in a reverse direction. Then, the sliding member 9 is pushed back by the claws 24 being in contact with the projections 25 of the lid 4, and the seal member 7 is returned to the original position together with the lid 4. As a result, when the cartridge 6 is removed from the device body 1, the developer 2 remaining in the cartridge 6 never leaks out. Also, since the device body 1 has the lid 4 closed when the cartridge 6 is removed, the developer 2 never splashes.

As has been described, the toner is supplied sealed in by the cartridge 6 and the device body 1, whereby the toner never splashes out and stains.

As will be recognized from the above description, according to the developer supplying structure of the first embodiment, the sliding member moves in the direction corresponding to the slide of the lid of the body of the developing device inside the one portion of the seal member as the seal member is separated from the cartridge, and the cooperative means makes the lid move in its opening direction. Thus, the toner is supplied sealed in by the cartridge and the device body, whereby the toner never splashes out and stains.

<Second Embodiment>

Figure 5:
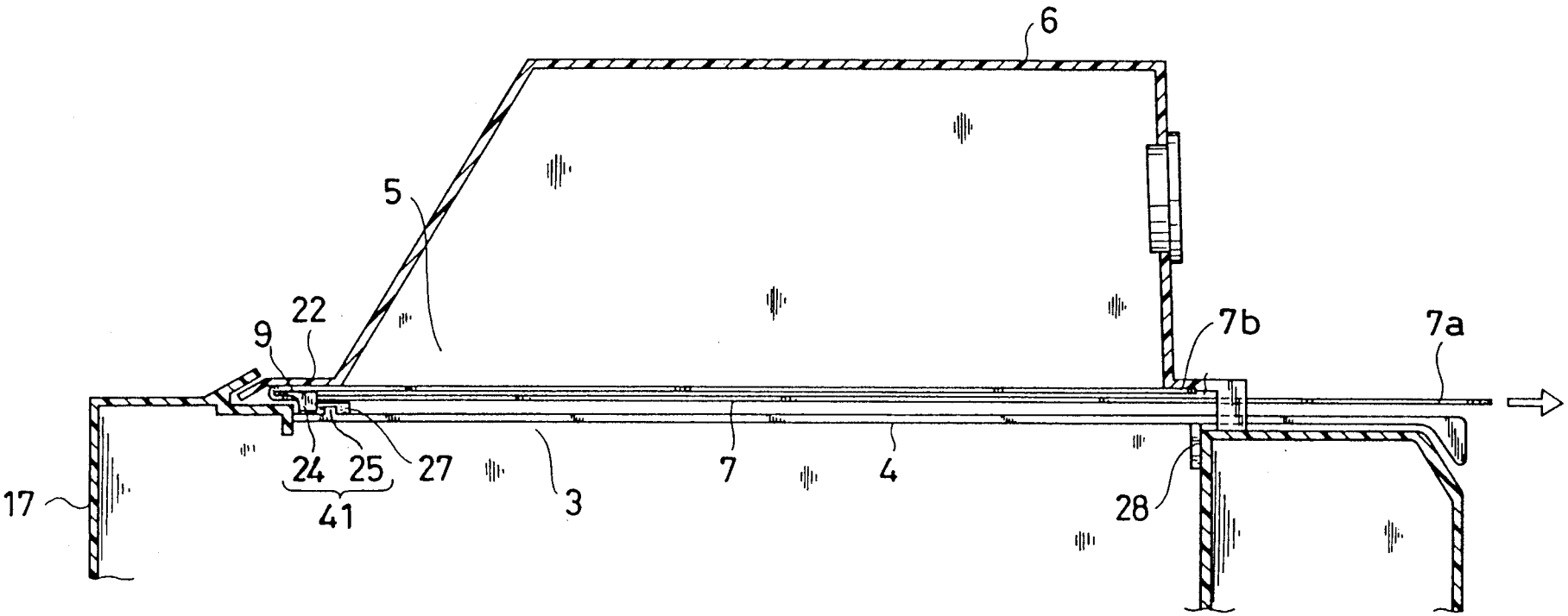
FIG. 5 is a sectional side view showing a second embodiment of the developer supplying structure of the developing device of the present invention, sealed with a seal member.
Figure 6:
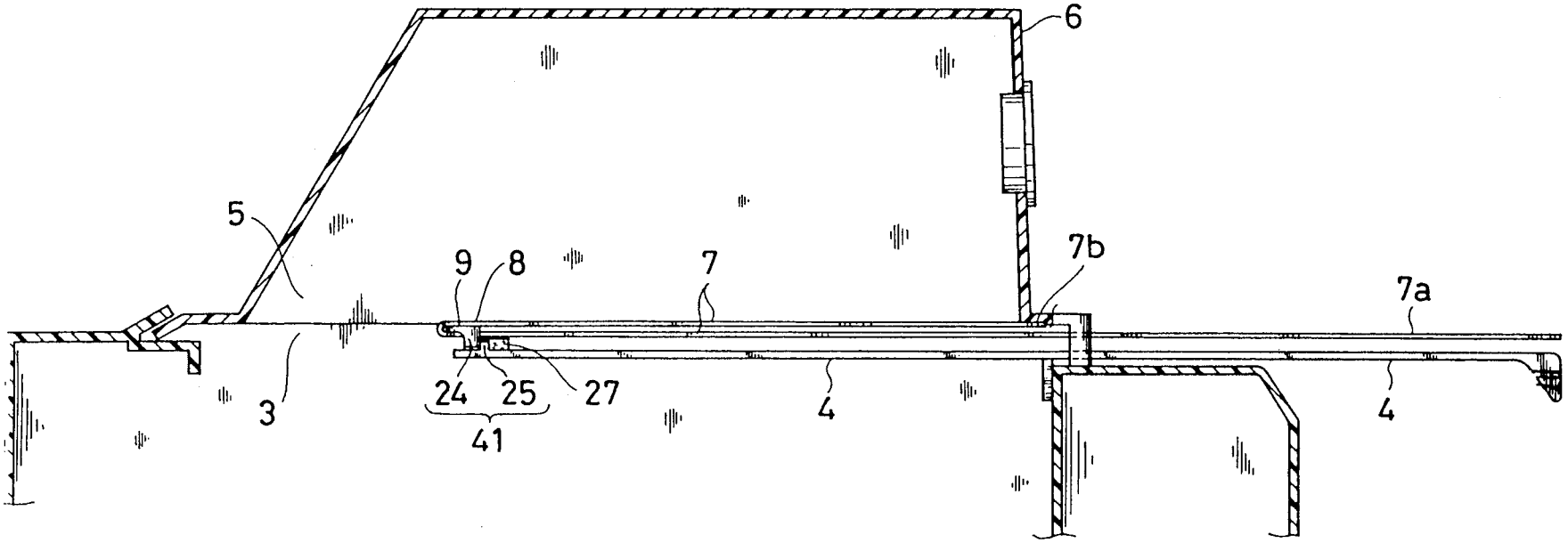
FIG. 6 is a sectional side view showing the second embodiment with the seal member being torn off.
Figure 7:
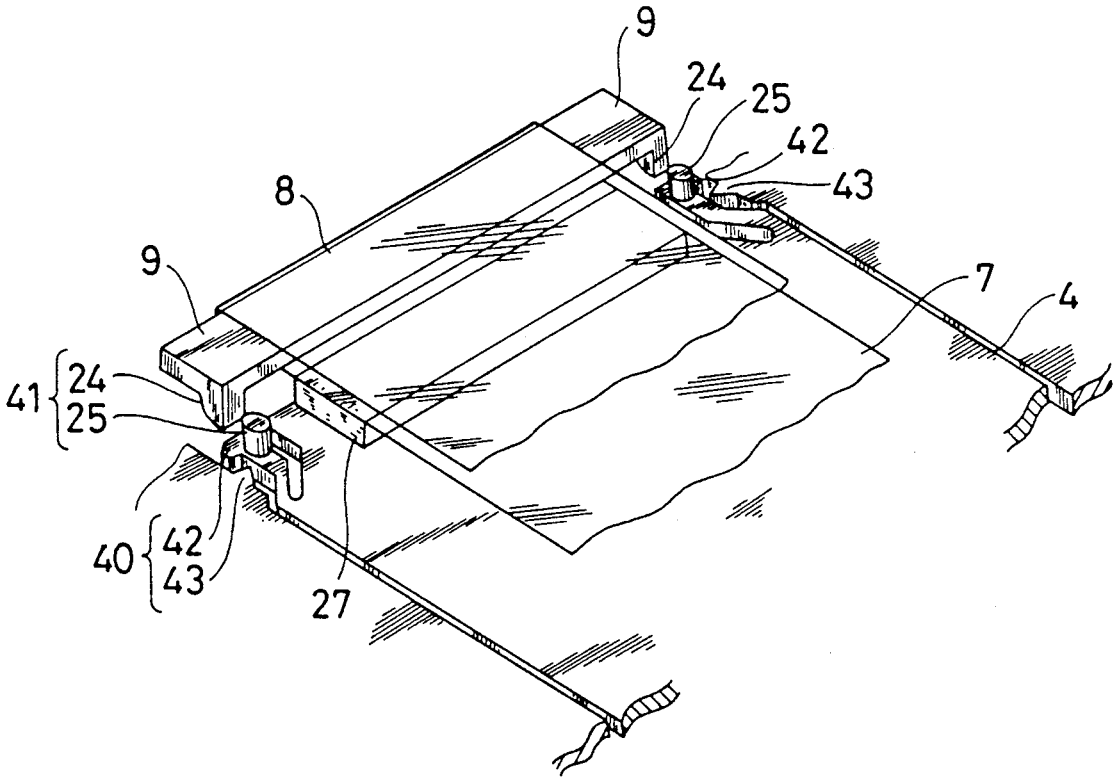
FIG. 7 is a perspective view showing the relations between a lock mechanism and lock release means in the second embodiment.

FIG. 5 is a sectional side view showing a second embodiment of the developer supplying structure of the developing device of the present invention, sealed with a seal member, FIG. 6 is a sectional side view showing the embodiment with the seal member being removed, and FIG. 7 is a perspective view showing the relationship between the lock mechanism and the release means.

As shown in these figures, the developer supplying structure of the developing device of the present invention includes a lock mechanism 40 for locking a lid to leave an opening of the device closed, and release means 41 interlocking with tearing off the seal member 7, for releasing the lock mechanism 40.

As shown in FIG. 7, the lock mechanism 40 consists of a pair of hooks 42 formed in opposite sides of the trailing edge of the lid 4 by cutting, having elasticity in the left and right directions from the center of the root thereof and oriented outward in the right and left directions, respectively, and projections 43 formed in the outermost trailing portion of the opening 3 of the body 1 of the developing device to detachably fit the hooks 42.

On the other hand, the release means 41 shakes the hooks 42 in the right and left directions from the center of the root thereof, comprising the claws 24 of the sliding member 9 explained in the first embodiment and the cylindrical projections 25 formed contiguous to the hooks 42 and coming in contact with the claws 24 when the lid 4 is in its closed position, also explained in the first embodiment. However, a centers of the projections 25 are in the position inside the left and right inner ends of the claws when the lock mechanism 40 is locked, so that the claws 24 come into contact with the projections 25 to shake the hooks 42 in the left and right inward directions from the center of the root thereof.

Other parts are the same as in the aforementioned first embodiment.

The functioning of the lock mechanism 40 and the release means 41 will be explained in the above-mentioned arrangement. The seal member 7 is pulled when the developer 2 is dispensed to move the sliding member 9 in the right direction from the position shown in FIG. 5 to the inside of one portion 8 of the seal member 7. Then, as shown in FIG. 7, the claws 24 of the sliding member 9 push the projections 25 of the lid 4 of the device body 1, and the hooks 42 are shaken inward from the center of the root thereof. As a result, the hooks 42 get pushed out of the projections 43, and the lock is released. As shown in FIG. 6, the claws 24 and the projections 25 remain in contact with one another, and then the lid 4 is moved in the right direction and the developer 2 is supplied into the device body 1.

After the developer has been supplied, the sliding member 9 and the seal member 7 are returned to the original position by shutting the lid 4.

When the hooks 42 engaged with the projections 43, the hooks 42 bend inward because of their shape and elasticity and mount over the projections 43 to fit thereto, and thus the lid 4 is locked.

In this way, even when the lid 4 in its closed position alone is pulled, the lock mechanism 40 works to prevent opening of the lid 4. The user cannot open the lid 4 and will therefore not splash the developer 2.

<Third Embodiment>

Figure 8:
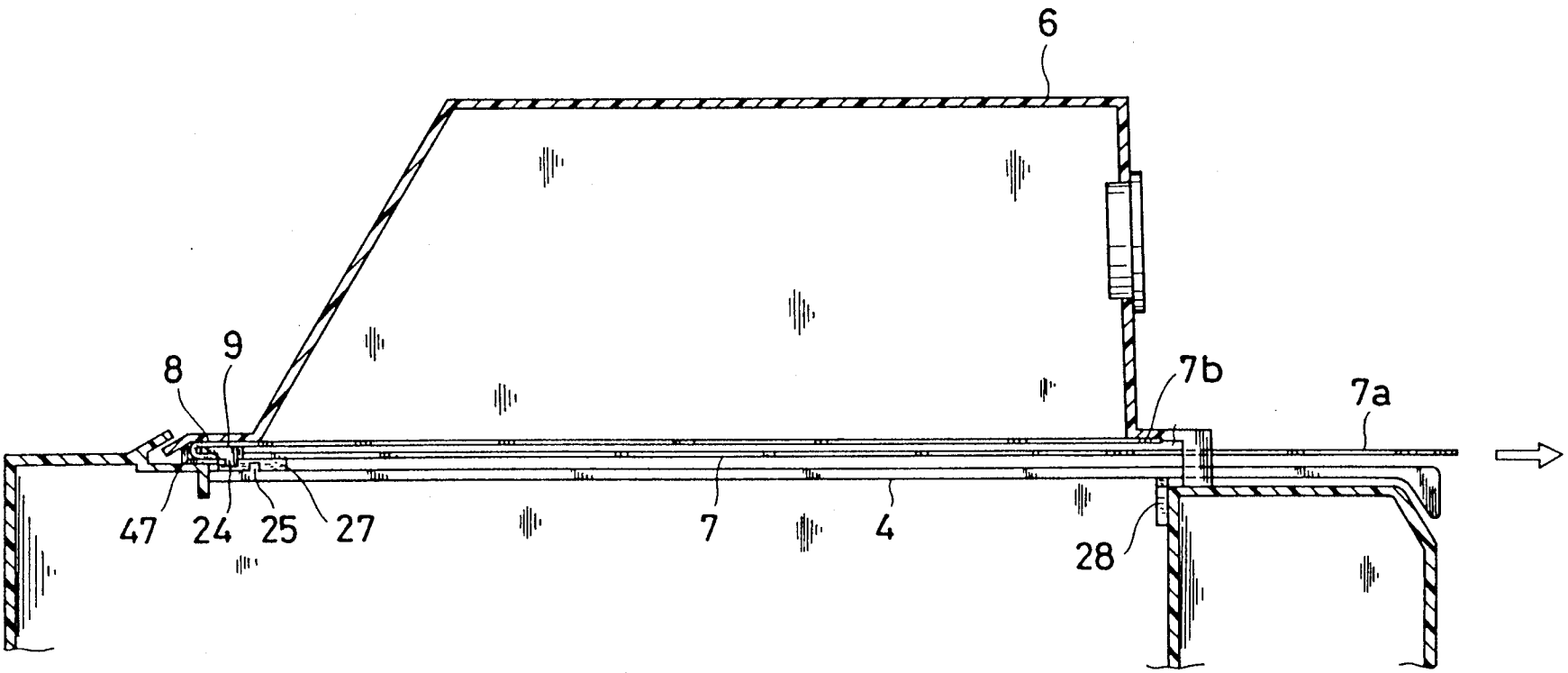
FIG. 8 is a sectional side view showing a third embodiment of the developer supplying structure of the developing device of the present invention, sealed with the seal member.
Figure 9:
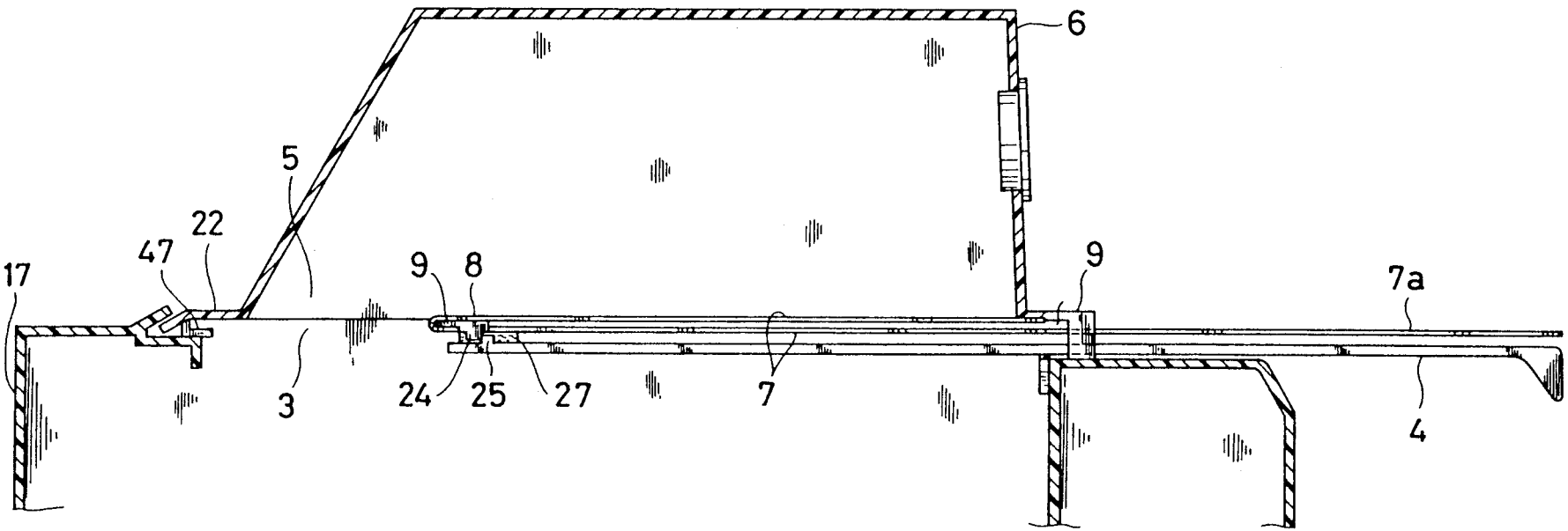
FIG. 9 is a sectional side view showing the third embodiment with the seal member being removed.
Figure 10:
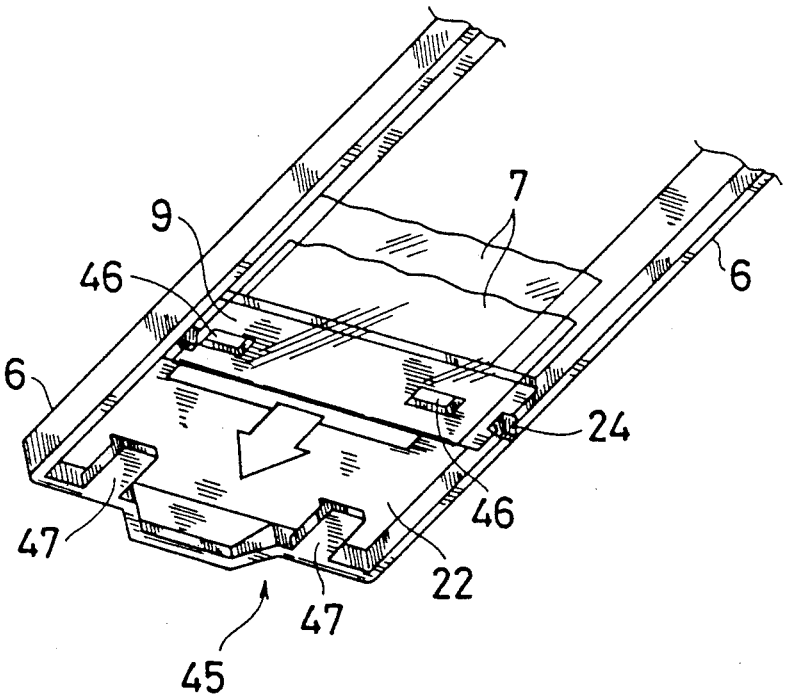
FIG. 10 is a perspective view showing a constitution of holding means in the third embodiment.

FIG. 8 is a sectional side view showing a third embodiment of the developer supplying structure of the developing device of the present invention sealed with a seal member, FIG. 9 is a sectional side view showing the third embodiment with the seal member being removed, and FIG. 10 is a perspective view showing a holding means of the third embodiment.

As shown in these figures, the developer supplying structure of the third embodiment includes holding means 45 for maintaining the sliding member 9 in the cartridge 6 after the supply of developer 2 to the body 1 of the developing device, in addition to the constitution of the above-mentioned first embodiment and to the combination of the first and second embodiments. A seal member 7 is used to close an opening through which the developer 2 is supplied.

As shown in FIG. 10, the holding means 45 includes a pair of apertures 46 formed laterally through the sliding member 9 and a pair of elastic claws 47 formed laterally in a back wall of the cartridge 6 to fit to the apertures 46.

Other parts of this embodiment are the same as those in the aforementioned first and second embodiments.

In the above description, when the cartridge 6 is sealed with the seal member 7, the claws 47 fit to the apertures 46 through one portion 8, as shown in FIG. 8.

In the state shown in FIG. 8, when the seal member 7 is pulled in the direction shown by an arrow, the claws 47 are unfitted from the apertures 46 because of the tensile force of the seal member 7 and the elasticity of the claws 47. When the seal member 7 is further pulled, the sliding member 9 and the seal member 7 move in the right direction as shown by the arrow in FIG. 8 to leave the outlet 5 open.

As the sliding member 9 moves, the lid 4 is moved through interlock means 10 to leave the opening of the body 1 of the developing device open, so that the developer 2 in the cartridge 6 is supplied to the body 1.

After dispensing of the developer 2, the lid 4 of the body 1 is moved in the left direction to close the opening on the body 1. Then, the claw 24 pushes the projection 25, which pushes the sliding member 9 to its original position, and thus the sliding member 9 fits to the claws 47 of the cartridge 6. When the sliding member 9 moves in the left direction, the seal member 7 is also returned to the original position to lie over the outlet 5 of the cartridge 6 as a simple cover.

As a result, the developer 2 remaining in the cartridge 6 does not splash from the outlet 5 when the cartridge 6 is detached from the device body 1. With the third embodiment, splashing of the developer is prevented more effectively than in the first and second embodiments.

As has been described, according to the developer supplying structure of the third embodiment, the holding means maintains the sliding member in the cartridge after the developer is supplied from the cartridge to the body of the developing device, and the seal member is used to close the opening of the cartridge after the developer is supplied, so that the developer in the cartridge is never splashed from the opening when the cartridge is detached from the device body. Thus, in accordance with the third embodiment of the present invention, an excellent effect can be obtained.

The present invention is not limited to the above embodiments. Various modification and changes may be made without departing from the scope of the present invention.

For example, although the body 1 of the developing device in the aforementioned embodiments consists of a developing unit and a supplying unit, the device body itself may be used as the developing unit and a cartridge may be directly attached to the developing unit to supply developer.

The lock mechanism 40 and the release means 41 are not limited to the aforementioned embodiments. The holding means may be changed so that the claws 47 are formed on the sliding member 9 and the apertures 46 are formed in the cartridge 6.

What is claimed is:

1. A developer supplying structure of a developing device, comprising:

a developer body formed with an aperture through which a developer is supplied;

a lid slidably attached to said developer body for selectively opening and closing said aperture;

a developer cartridge formed with an outlet corresponding to said aperture formed in said developer body, said developer cartridge being detachably mounted on said developer body;

a seal member folded in two portions wherein one portion seals said outlet of said developer cartridge and the other portion is left free as a flap, said seal member being separated from said outlet of said developer cartridge by pulling said flap thereby breaking the seal formed by said one portion;

a sliding member provided between and at a fold of said two portions of said seal member and slidable with said lid; and means for connecting said sliding member to said lid and moving said lid with movement of said sliding member in a direction for opening said developer body, wherein said lid is simultaneously removed upon removal of said seal and said seal is simultaneously replaced upon replacement of said lid.

2. A structure according to claim 1, wherein said means for connecting comprise a pair of projections laterally formed in a trailing edge of said lid and a pair of claws integrally depending from said sliding member and in contact with said projections and moving said lid in a direction exposing the aperture of said developer body.

3. A structure according to claim 2, wherein each of said projections contacts a corresponding one of said claws to move said sliding member in a direction for closing the aperture of said developer body, so that said seal member seals said outlet of said developer cartridge.

4. A structure according to claim 1, wherein said lid is provided with a first cleaning member in contact with a reverse side of said seal member facing away from said aperture to remove developer therefrom.

5. A structure according to claim 1, wherein said outlet of said developer body is provided with a second cleaning member in contact with the reverse side of said lid facing said aperture to remove developer therefrom.

6. A structure according to claim 1, wherein said lid is provided with a lock mechanism for locking said lid to prevent removal from said aperture of said developer body and release means for releasing said lock mechanism upon movement of said sliding member cooperative with pulling said flap of said seal member.

7. A structure according to claim 6, wherein said lock mechanism includes a pair of projections laterally positioned in an edge of a rear wall of said developer body and a pair of hooks laterally positioned on said lid for cooperation with said projections thereby locking said lid in its closed position;

said release means including a pair of projections formed contiguous to said hooks and claws formed in said sliding member and in contact with the pair of projections when said sliding member is moved in accordance with pulling said flap of said seal member, to deform said hooks, for unlocking said closed lid.

8. A structure according to claim 1, wherein said cartridge includes holding means for holding said sliding member in said cartridge when said lid is closed so that said outlet of said cartridge will remain closed by said seal member.

9. A structure according to claim 8, wherein said holding means are a combination of apertures formed in said sliding member and elastic claws formed in side walls of said cartridge and selectively contacting with said apertures when said lid is closed, thereby securing said sliding member in said cartridge.

10. A structure according to claim 1, wherein said lid and said flap of said seal member are moved in the same direction.

11. A developer supplying structure of a developing device, comprising:

a developer body formed with an aperture through which a developer is supplied;

a lid slidably attached to said developer body for selectively opening and closing said aperture;

a developer cartridge formed with an outlet corresponding to said aperture formed in said developer body, said developer cartridge being detachably mounted on said developer body;

a seal member folded in two portion, wherein one portion seals said outlet of said developer cartridge and the other portion is left free as a flap, said seal member being separated from said outlet of said developer cartridge by pulling said flap and thereby breaking the seal formed by the one portion;

a sliding member provided between said two portions of said seal member and slidable with said lid; and means for connecting said sliding member to said lid and moving said lid with the movement of said sliding member in a direction for opening said developer body;

wherein said lid is provided with a lock mechanism for locking said lid in a closed position to said developer body and release means for releasing said lock mechanism upon movement of said sliding member cooperative with pulling said flap of said seal member and wherein said lock mechanisms includes a pair of projections laterally positioned in an edge of a rear wall of said developer body and a pair of hooks laterally positioned on said lid for cooperation with said projections thereby locking said lid in its closed position;

said release means including a pair of projections formed contiguous to said hooks and claws formed in said sliding member and in contact with the pair of projections when said sliding member is moved in accordance with pulling said flap of said seal member to deform said hooks, for unlocking said closed lid.

12. A structure according to claim 11, wherein said means for connecting comprise a pair of projections laterally formed in a trailing edge of said lid and a pair of claws in contact with said projections and moving said lid in a direction exposing the aperture of said developer body.

13. A structure according to claim 12, wherein each of said projections contacts a corresponding one of said claws to move said sliding member in a direction for closing the aperture of said developer body, so that said seal member seals said outlet of said developer cartridge.

14. A structure according to claim 11, wherein said lid is provided with a first cleaning member in contact with a reverse side of said seal member facing away from said aperture to remove developer therefrom.

15. A structure according to claim 11, wherein said outlet of said developer body is provided with a second cleaning member in contact with the reverse side of said lid facing said aperture to remove developer therefrom.

16. A structure according to claim 11, wherein said cartridge includes holding means for holding said sliding member in said cartridge when said lid is closed so that said outlet of said cartridge will remain closed by said seal member.

17. A structure according to claim 16, wherein said holding means are a combination of apertures formed in said sliding member and elastic claws formed in side walls of said cartridge and selectively contacting with said apertures when said lid is closed, thereby securing said sliding member in said cartridge.

* * * * *